US010023348B2

(12) United States Patent
D'Amato

(10) Patent No.: US 10,023,348 B2
(45) Date of Patent: Jul. 17, 2018

(54) STACKABLE CONTAINER

(75) Inventor: Gianfranco D'Amato, Arzano Napoli (IT)

(73) Assignee: Seda S.P.A., Arzano, Napoli (IT)

( * ) Notice: Subject to any disclaimer, the term of this patent is extended or adjusted under 35 U.S.C. 154(b) by 365 days.

(21) Appl. No.: 13/044,886

(22) Filed: Mar. 10, 2011

(65) Prior Publication Data

US 2012/0006888 A1 Jan. 12, 2012

Related U.S. Application Data

(60) Provisional application No. 61/312,320, filed on Mar. 10, 2010.

(51) Int. Cl.

| | |
|---|---|
| ***B65D 3/00*** | (2006.01) |
| ***B65D 3/12*** | (2006.01) |
| *B31B 105/00* | (2017.01) |
| *B31B 110/10* | (2017.01) |

(52) U.S. Cl.

CPC ..... *B65D 3/12* (2013.01); *B31B 2105/00* (2017.08); *B31B 2110/10* (2017.08)

(58) Field of Classification Search

CPC .... B65D 1/265; B65D 21/0233; B65D 21/02; B65D 21/04; B65D 81/3869; B65D 3/12; A47G 19/23; B31B 2105/00; B31B 2100/10

USPC ..... 206/503; 220/62.18, 62.2; 229/4.5, 400, 229/403, 103.11

See application file for complete search history.

(56) References Cited

U.S. PATENT DOCUMENTS

| | | | | | |
|---|---|---|---|---|---|
| 703,711 | A | * | 7/1902 | Seaman | 206/520 |
| 1,057,426 | A | | 4/1913 | Heyl | |
| 2,074,325 | A | * | 3/1937 | Carew | 229/5.5 |
| 2,266,828 | A | * | 12/1941 | Sykes | 220/1.5 |
| 3,464,587 | A | * | 9/1969 | Edwards | 206/520 |
| 4,049,122 | A | * | 9/1977 | Maxwell | 206/519 |
| 6,109,518 | A | * | 8/2000 | Mueller et al. | 229/403 |

(Continued)

FOREIGN PATENT DOCUMENTS

| | | | | |
|---|---|---|---|---|
| DE | 20012593 | U1 | 12/2000 | |
| EP | 1174346 | A1 * | 1/2002 | B65D 3/06 |

(Continued)

OTHER PUBLICATIONS

EPO Official Communication dated Dec. 17, 2013 in corresponding EP Application No. EP 11 707 607.

(Continued)

*Primary Examiner* — Ernesto Grano

(74) *Attorney, Agent, or Firm* — Fish & Richardson P.C.

(57) ABSTRACT

A container for receiving foodstuff or dried beverages comprising a surrounding container wall, an upper container opening and a bottom part opposite to the container opening and connected to a lower end section of the container wall, wherein the bottom part includes an essentially flat bottom section and an abutment flange which protrudes at least in some locations from the bottom section in the direction of the container opening, and the lower end section of the container wall includes a support ring protruding radially inwards from the end section. The bottom part and the lower end section is connected between the abutment flange, an inner side of the container wall, and between the lower side of the bottom section and an upper side of the support ring.

9 Claims, 10 Drawing Sheets

(56) References Cited

U.S. PATENT DOCUMENTS

| | | | | |
|---|---|---|---|---|
| 6,136,396 | A * | 10/2000 | Gilmer | 428/36.5 |
| 7,481,356 | B2 * | 1/2009 | Stahlecker | 229/403 |
| 2001/0050287 | A1 * | 12/2001 | Namba et al. | 220/592.17 |
| 2003/0111475 | A1 | 6/2003 | Cheng | |
| 2005/0115975 | A1 * | 6/2005 | Smith et al. | 220/592.17 |
| 2005/0133183 | A1 * | 6/2005 | Mohan et al. | 162/164.1 |
| 2005/0211758 | A1 | 9/2005 | Liou | |
| 2006/0196923 | A1 * | 9/2006 | Tedford, Jr. | 229/403 |
| 2006/0226210 | A1 * | 10/2006 | Stahlecker | 229/403 |
| 2008/0087677 | A1 | 4/2008 | Robertson et al. | |
| 2009/0242574 | A1 | 10/2009 | Li | |

FOREIGN PATENT DOCUMENTS

| | | | |
|---|---|---|---|
| GB | 2 420 267 | A | 5/2006 |
| JP | 61043113U | U | 3/1986 |
| JP | 2003054654 | A | 2/2003 |
| WO | WO 2009130315 | A1 | 10/2009 |

OTHER PUBLICATIONS

Notice of Opposition filed on Oct. 15, 2015 in corresponding European Patent No. EP 2 544 953 B1.

* cited by examiner

STACKABLE CONTAINER

FIELD OF THE INVENTION

The invention relates to a container for receiving foodstuff or dried beverages comprising at least a surrounding container wall, an upper container opening, in particular closeable by a lid part and a bottom part opposite to the container opening which is connected to a lower end section of the container wall.

BACKGROUND OF THE INVENTION

Such containers are illustrated by the prior art, and particularly with respect to the bottom part illustrated through different embodiments in FIGS. 1 to 3.

FIG. 1 illustrates a container 1 in a lower section of the container wall 2 with a bottom part 5. In FIG. 1 the container wall 2 comprises at its lower ends u-shaped, as well as inwards and upwards turned open ends. Into these open ends the bottom part is arranged with its downwards protruding border flange.

With respect to the container 1A of FIG. 2 the respective connected parts of the container wall 2A and the bottom part 5A according to FIG. 1 are turned inwardly.

With respect to another container 1B according to FIG. 3 a lower end of the container wall 2B is radially turned inwards and serves as a basis for a flat bottom part 5B.

With respect to the container as illustrated in FIGS. 1 and 3, additionally insertion limitations 19 are disclosed, which for example are formed as inwardly protruding sections of the container wall 2. Those insertion limitations 19 might serve to hold another container which for example could be stacked into one of the illustrated containers from an upward direction.

In general those containers are suitable for receiving foodstuff or dried beverages, and for the consumption of same or at least for further processing of the respective foodstuff or dried beverages within the containers. The respective foodstuff or dried beverages can be made available in the container in a cooled or heated condition. Additionally, the foodstuff or dried beverages can be provided in a powder like, pourable or other in general dry manner for further preparation. Such a preparation for example could be an automatic processing of the discussed foodstuff or dried beverages, or also usage in the chemical industry. After filling the respective container with some foodstuff or dried beverage it can be closed by a lid part. With a provided lid part or even after the opening of the lid part, or through openings in the lid part, and eventually in the bottom part, a respective preparation of the beverage or foodstuff could follow.

With respect to the previously described containers which are part of the prior art, it has proven disadvantageously that with the application of respective containers at the filling of foodstuffs or dried beverages, at the application of respective containers by the user, or with the respective preparation or automatic processing of the containers with foodstuff or dried beverages, stability of the containers, and impermeability in particular in the area of the bottom part are partially insufficient.

With respect to the container as for example illustrated by FIG. 1, the standing surface is relatively small, so that during the filling of the containers additional arrangements for stability are necessary. The standing surface of the container as illustrated by FIG. 2 is comparatively bigger, however, through the multi-layered arrangement of the respective parts of the bottom part and the container wall in the area of the holding area, the production of the container is complicated and compared with the container of FIG. 2 offers less container volume with an equal container height.

With respect to the container as illustrated by FIG. 3, problems with respect to fluid tightness or impermeability could occur, in particular in the area of the bottom part, as the respective connection of the bottom part and the container wall might not be sufficient in this area.

It is another disadvantage for the containers as illustrated by FIGS. 1 to 3 that for example irregularities in the thickness of the standing surface or arrangements which are positioned onto the same could apply pressure onto the bottom part which would negatively effect the connection between the bottom part and the container wall with respect to a respective fluid tightness or impermeability. In particular this is not only effecting the container 1B of FIG. 3 which comprises an uneven bottom part.

In all three types of containers according to FIGS. 1 to 3, a respective tensile load onto the lower end section of the container wall onto which the bottom part is arranged will result through a compression load of the bottom part 5. This could be responsible for, pushing the lower end section further in an inward direction of the container and separating the connection between the bottom part and the container wall and could also lead to a respective deforming of the container wall upwards from the bottom part.

OBJECT OF THE INVENTION

It is the object of the present invention to improve such previously described containers in such a way, that a secure standing of the container can be guaranteed, as well as that the container is suitable for the absorption of compression forces in particular onto the bottom part without any negative influence of the impermeable connection between the bottom part and the container wall. This is in particular advantageous for the application of the container for automatic filling with foodstuffs or dried beverages, but also for the preparation of the respective addition or the further automatic processing. At the same time, a respective standing area of the container should be available in a sufficiently big and robust manner, in order to be able to also rest the container on uneven surfaces. Additionally the invention relates to the production of the inventive container in its preferred form, stability, stackability, impermeability, etc.

SUMMARY OF THE INVENTION

The solution for the above described object is achieved with a container construction in which the bottom part includes an essentially flat bottom section and an abutment flange which protrudes at least in places from the bottom section in the direction of the container opening, and the lower end section of the container wall comprises a support ring, which essentially protrudes radially inwards from the end section, wherein a connection of the bottom part and lower end section is effected between the abutment flange and an inner side of the container wall, and between the lower side of the bottom section, and an upper side of the support ring.

By this kind of bottom structure a flat bottom can be achieved which is partially two-layered. There are many options for connecting the bottom part and the container wall, so that besides a secure standing area with minimal thickness of material, good conditions for further automatic processing of the containers for filling or pouring are also obtained. Even with uneven standing surfaces including protrusions such as burlings or the like, a secure standing of the container can be achieved and at the same time it is guaranteed by the pushing of the bottom part in an inward direction of the container that the connection between the bottom part and the container wall keeps it impermeable, i.e., fluid tight. Even with a pushing of the bottom part until a breakthrough of the bottom area, the inner volume of the container is only opened at the area of the breakthrough, wherein the connection between the container wall and the bottom part remains impermeable.

The respective impermeability of the connection between the container wall and the bottom part can also be maintained, in case the bottom part is pushed downwardly by the weight of a filled foodstuff or dried beverage, such as instant coffee, soup or tea in powder form, or in case of an outwards compression force, in an upward direction to the container opening.

Forces are transmitted in particular through the connection between the abutment flange and the inner side of the container wall in an advantageous manner onto the container.

The respective force transmission or the connection between the bottom part and the container wall can be improved in that the abutment flange extends in the circumferential direction of the bottom section and/or the support ring extends in the circumferential direction of the container wall. Using this arrangement, the impermeability of the connection can be improved. Depending on the length of the abutment flange there is the possibility to reduce or to increase the respective length of the support ring. The respective lengths of the abutment flange and the support ring can be adapted to the requirements and the application of the container.

The transition between the container wall and the support ring can be edged, wherein it is also possible that the transition is rounded.

In another improved embodiment of the invention, the container wall and/or the bottom part can be made of paper, cardboard or the like, and at least comprise a fluid dense coating on corresponding inner side. Such material can be easily sorted after usage or is suitable for recycling.

If such a material is used with wet or fluid foodstuffs or dried beverages, a respective fluid dense coating can be provided at least onto the inner side of the container wall and/or the bottom part. For example such coating could comprise a plastic material such as polyethylene or another heatable and meltable, fluid dense, i.e. fluid impermeable, material.

The respective outside of the container wall can be even or corrugated. Additionally there is the possibility that at least the container wall comprises two layers, wherein in particular the outer layer has a corrugated structure.

In case of a smooth outside, a simple printability of the container is given.

Of course, the respective coating may not only be provided on the inner side of the container wall and/or the bottom part, but also on the outside thereof.

According to the invention the container is usually made of a two dimensional pre-cut or blank of the container wall which particularly is connected in an overlapping area. In the contact area, and in particular in the total contact area, an adhesive can be provided between the container and the bottom part, in order to connect the bottom part with the respective container wall. Such an adhesive can be a cold glue or a hot glue.

The connection between the container wall and the bottom part of the container is also producable by providing a dense coating of meltable material such as polyethylene in particular in the total contact area of the container wall and the bottom part. The coating is heated until reaching its softening point or its melting point, and then the respective parts are pushed together in the contact area, wherein after hardening of the coating a fluid dense connection is produced.

It is also possible to use combinations of adhesives and coatings for a connection.

In particular for storing a plurality of containers those are usually stacked together. In this manner the containers are transported for filling to different machines and are separated from each other.

In order to simplify the disconnection of the stacked containers, the containers according to the embodiments illustrated by FIGS. 1 and 3 comprise insertion limitations in the form of protrusions that extend inwardly from the container wall. Such insertion protrusions prevent insertion of one container too far into another, so that a simple separation of the stacked containers is guaranteed.

According to the invention this can be solved easily in that an upper end of the abutment flange directed essentially in the direction of the container opening is formed as an insertion limiting means for a further container inserted in said container. That means, additional insertion limitations are not required, compared to FIGS. 1 and 3.

If a relatively thin material is used for the bottom part with the respective abutment flange, the insertion limiting means can be improved in that the abutment flange comprises an end section bent or folded radially inwards in an inclined direction. With this arrangement, the insertion limiting means for the inserted container are improved, wherein the ability to stack or unstack the containers to or from one another is provided in a simple manner.

Such a bended or folded end section can also be used for a bottom part made of a thicker, or, compared to container wall, equally thick material.

A double walled container wall was already mentioned above, wherein it has been proved sufficiently, if the container wall in particular outside of the lower end section is double walled. The double walled structure can be achieved for example through a respective shell which is directly arranged onto the container wall and essentially fixed onto the same without a gap. Additionally it has proved advantageous if the double-walled container wall comprises an insulating gap, i.e., the container walls are spaced apart from one another to form an air space and thereby create an insulating gap. In the insulating gap, for example air can be used as a means to reduce the heat transfer between the inside of the container and the outside of the container.

The respective shell of the container can comprise ripples or other protrusions to space apart the inner container wall of the container from the outer wall container and for formation of an isolating gap between those containers. A connection between the shell and the container wall can be provided by adhesive dots or adhesive stripes, wherein it is also possible, that the respective connection is only provided by friction.

A respective embodiment of container wall and bottom part with a fluid dense coating is not necessary, if the container comprises a fluid dense insert, which insert includes at least an insert wall and an insert bottom part at the lower end of the insert wall, wherein the insert bottom wall rests on the bottom section when the insert is inserted in the container. In this case the fluid density is provided by the insert. In an improved embodiment, the insert can be separated from the container for recycling or the like.

The insert wall, see also the container wall, can be formed for example in a cup shaped manner and comprise respective measurements for insertion in the inner volume of the container. The insert can also be completely surrounded by the container wall, so that the insert does not protrude from the container opening. There, the insert is pushed as deep as possible into the container volume, so that in a respective insert position contact between the insert bottom part and the bottom part of the container is established. The insert comprises a respective upper insert opening which can be assigned to the container opening or can form the same, if the insert wall ends together with the container wall, or protrudes from the container wall in an upward direction.

There is also the possibility that the lid part is fixed to the insert. In this arrangement the insert comprises an edge flange at its upper insert opening which edge flange at least in places protrudes radially outwards. This edge flange can overlap an upper end of the container wall. The insert can be made of resin.

With such a material it is additionally advantageous, if the insert including the insert wall and the insert bottom part is formed as a one part insert.

The dimensions of the insert or the insert wall and the container wall can be chosen such that a friction fit between the insert wall and the container wall is provided after the insertion of the insert. There is also the option that the insert and in particular the insert wall and the container wall are connected to each other. This connection can also be provided between the insert bottom part and, for example, the even bottom area of the bottom part.

The respective connection may point-wise, in surface sections or in total areas of the respective surface sections between the insert and the container wall or the bottom part, be achieved using adhesive. The connection also may be fluid dense.

In order to simplify the insertion of the insert into the container wall until a contact with the bottom part, in particular with respect to the abutment flange, the insert bottom part can be connected to the insert wall via a supporting step protruding essentially radially inwards. Through that, the section of the insert arranged downward of the supporting step wall is reduced in its diameter and is able to be moved in a simple manner in particular along the upper end of the upper end section of the abutment flange.

There it could be advantageous, if the supporting step is arranged above the upper end of the abutment flange in direction to the container opening.

The respective supporting step can be used as an insertion limiting means for another container inserted into the container. Through this arrangement, the ability to easily destack respective containers can be realized.

If a respective coating or even a respective adhesive is provided on the upper surface of the bottom part, a connection between the insert bottom part and the bottom part can be established.

In order to provide an access to the foodstuff or dried beverages filled in the container, for preparation or the like, the supporting ring can surround an access section of the flat bottom section. Through this access section, automatic processing, preparation and/or pouring of the foodstuffs and the dried beverages can be achieved. This can be achieved in an analogue way or additionally through the lid part and/or container wall.

With or without an insert the container wall can comprise at its upper end a rolled or folded edge which surrounds the container opening. This edge can be used to affix a respective lid part.

With respect to the foodstuffs and dried beverages, it might be mentioned, that those can be provided in a solid or fluid form, or even dry or in particular powder like or trickling form.

The foodstuffs or dried beverages can be suitable for direct consumption from the container or first be prepared within the container, wherein the foodstuff may be consumed from the container after the preparation.

Respective preparations of such foodstuffs or dried beverages can be achieved through the supply of cooling energy, heat, liquid or the like. Eventually even through a combination thereof.

DESCRIPTION OF THE DRAWINGS

Advantageous embodiments of the invention with respect to the figures are described in the following.

The following figures are illustrated.

DETAILED DESCRIPTION OF THE INVENTION

Figure 1:
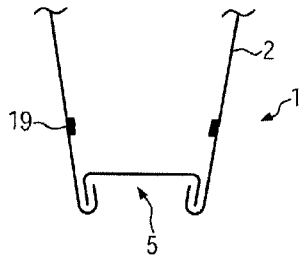
FIG. 1 is a cross-section of a container as used in the prior art.
Figure 2:
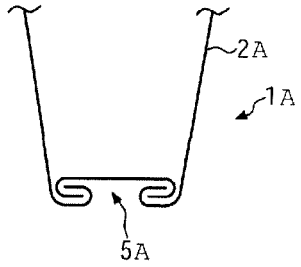
FIG. 2 is a cross-section analogue to FIG. 1 through another prior art container.
Figure 3:
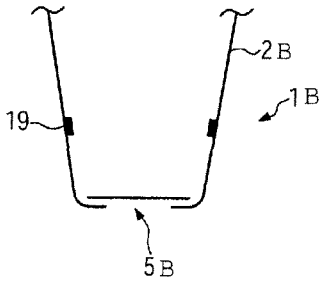
FIG. 3 is a cross-section analogue to FIG. 1 through another prior art container.
Figure 4:
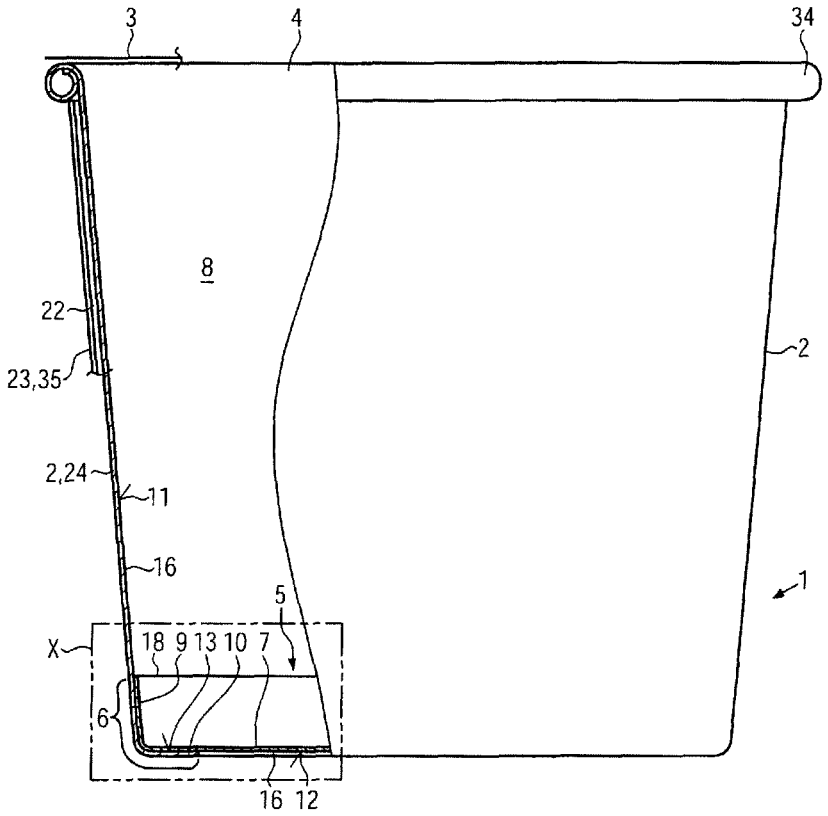
FIG. 4 is a first embodiment of the container of the present invention partially illustrated in a cross-section.

In FIG. 4, a partially cross-sectional side view of a first embodiment of the inventive container 1 is illustrated. The container 1 comprises in an upwards direction, a conically extended container wall 2 which surrounds a container opening 4. An upper edge 34 of the container wall 2 is rolled outwardly. Onto the edge 34, a container lid part 3 can be arranged and fixed along the edge. The lid part 3 closes the container opening 4.

The container 1 according to FIG. 4 can be a double walled container with respect to container wall 2 as an inner wall 24 and with respect to the isolating shell 35 as an outer wall 23. The isolating shell 35 is mounted onto the container wall 2 from a downward direction and usually covers at least a part of the container wall height and occasionally reaches down to the lower end of the container 1. Between the inner wall 24 and the outer wall 23, an isolating gap 22 is formed. The gap 22 is filled with air and serves to reduce a respective heat transfer between the two walls.

On an inner side 11 of the container 2, a fluid dense coating 16, for example, made of polyethylene or the like, in particular, a thermo-reactive material is applied. This is applied analogue for the lower side 12 of a bottom part 5.

The bottom part 5 comprises an essentially flat bottom section 7 which is surrounded by an abutment flange 9 protruding in an inclined direction to the container opening 4. The abutment flange 9 lies against the inner side of the container wall 2. The container wall 2 comprises a lower end section 6 which ends in a radially inwards protruding support ring 10.

Generally, the lower end section 6 serves for adjusting the bottom part 5 and in particular, the abutment flange 9 and with a part of the flat bottom section 7.

Adjustment between the bottom part 5 and the container wall 2 is achieved between the outer side of the abutment flange 9 and the inner side 11 of the container wall 2 as well as between the lower side 12 of the flat bottom section 7 and the upper side 13 of the support ring 10. The supporting ring 10 surrounds the flat bottom section 7 and keeps an access section 33 free, as illustrated in FIG. 5.

The bottom part 5 is upwardly adjustable through the container opening 4 into the container 1 and then can be connected with the support ring 10 or with another section of the lower end section 6, respectively. This connection can be achieved through cold or hot gluing. Another option for the connection is the fluid dense coating 16 which at least partially is heated up to its softening or up to its melting point and will harden after contact between the bottom part and the container wall. Through these procedures a respective connection between the parts can be achieved through the coating.

Figure 5:
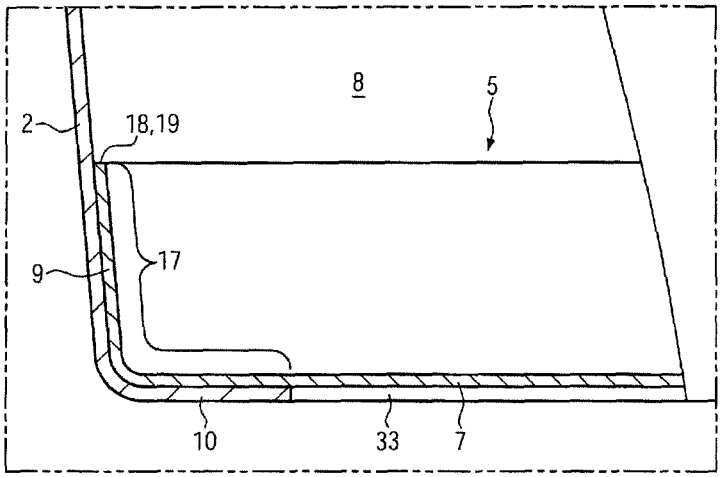
FIG. 5 is an enlarged illustration of detail "X" of FIG. 4.

In FIG. 5, a detail "X" of FIG. 4 is illustrated in an enlarged view.

In this Figure, as in the following Figures, the same parts are identified with the same reference numerals and will be described only partially in view of the respective Figure.

A connection between the bottom part 5 and the container wall 2 is achieved in the contact area 17 which essentially extends between the bottom part 5 and the support ring 10 or the lower end of the container wall 2, respectively. Through the connection within the contact area 17, compression loads onto the flat bottom section 7 in particular in the access area 33 can be absorbed, which can deform the bottom section 7 into the container inner volume 8. The respective compression load is absorbed by the connection between the abutment flange 9 and the container wall 2 and eventually, transforms into a deformation of the container in this section.

According to the invention, a solid connection in the contact area 17 keeps its fluid density, even if the compression load of the flat bottom section 7 leads to a perforation of same. With the solid connection between the bottom part and the container wall, it is also guaranteed that the container can be positioned onto an uneven surface with protruding sections such as burlings or the like, wherein such protrusions could cause a deformation of the bottom section 7. Additionally, the bottom of the container 1 is only double layered by the bottom part 5 and the support ring 10, so that only a small volume in comparison to other containers with the same height is reduced and at the same time, a solid connection between the bottom part and the container wall and a good standing can be achieved.

Figure 6:
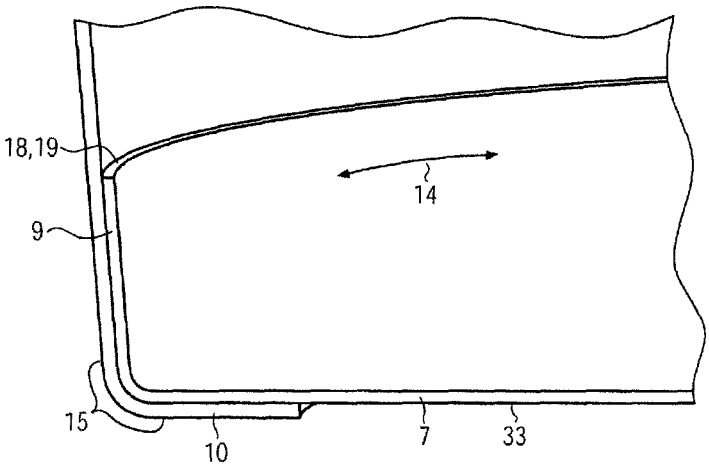
FIG. 6 is an illustration analogue to FIG. 5 in a perspective view.

FIG. 6 is an illustration analogue to FIG. 5 in a perspective view.

In this illustration it can be seen that an upper end 18 of the abutment flange 9 protrudes and runs in a circumferential direction 14 around the entire circumference of the container or the container wall 2, respectively. The upper end 18 is applied as an insertion limiting means 19 as is also illustrated by the following embodiments.

In FIG. 6, a transition 15 is illustrated between the support ring 10 and the container wall 2 which is particularly rounded. The transition 15 can also be formed as an edge.

Figure 7:
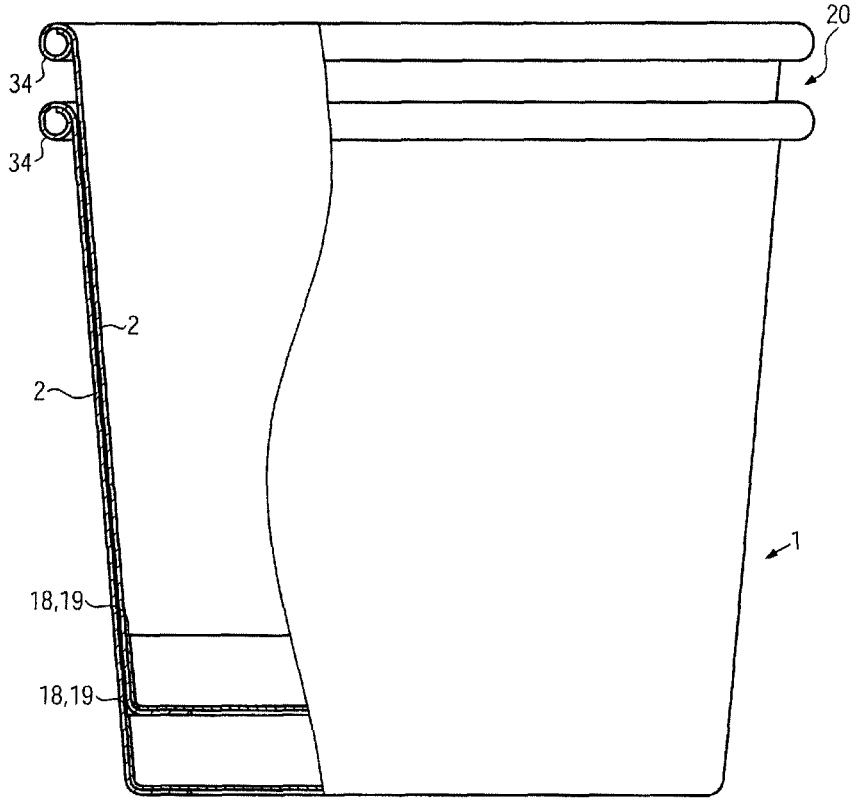
FIG. 7 shows two stacked containers analogue to FIG. 4.

FIG. 7 illustrates two stacked containers with respect to container 1 and the other container 20. In particular, it is recognizable that the upper end 18 of the formed insertion limiting means 19 lies against the container wall 2 or the bottom of the additional container 20, respectively, in order to prevent a further insertion of the container 20 into the container 1. The container 20 is only inserted so far into the container 1 that in general circumstances no contact between the container walls 2 of both containers is achieved. By this, a good disconnection of the containers 1 and 20, as well as even more stacked containers is possible.

With respect to the double walled container according to FIG. 4, it is suggested for FIG. 7, as well as the further figures that such a double walled design is also possible for other embodiments according to the further figures.

Figure 8:
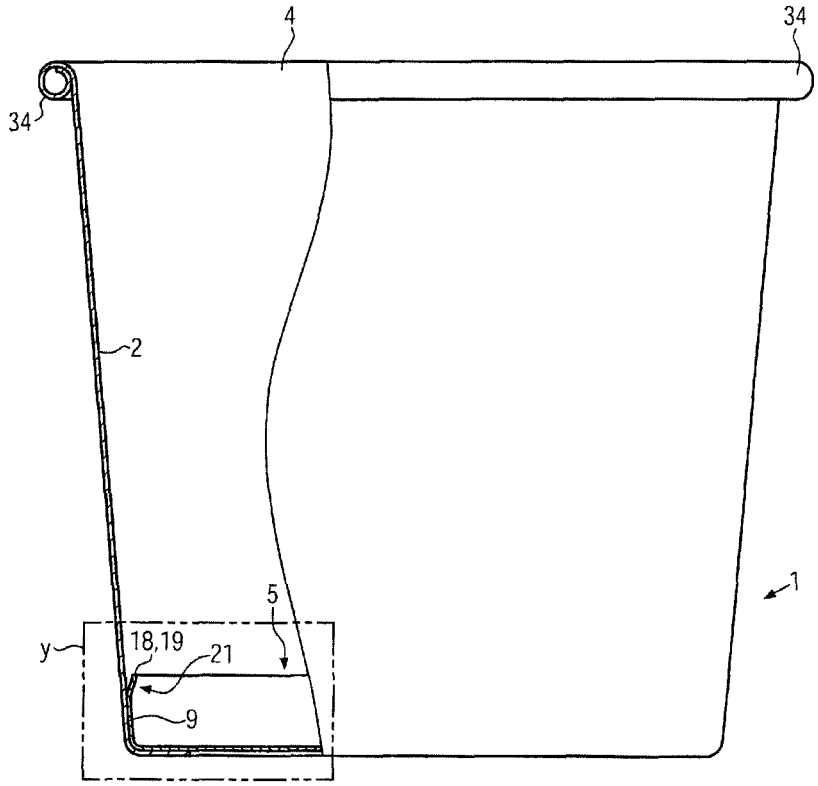
FIG. 8 is a second embodiment of the inventive container analogue to FIG. 4.
Figure 9:
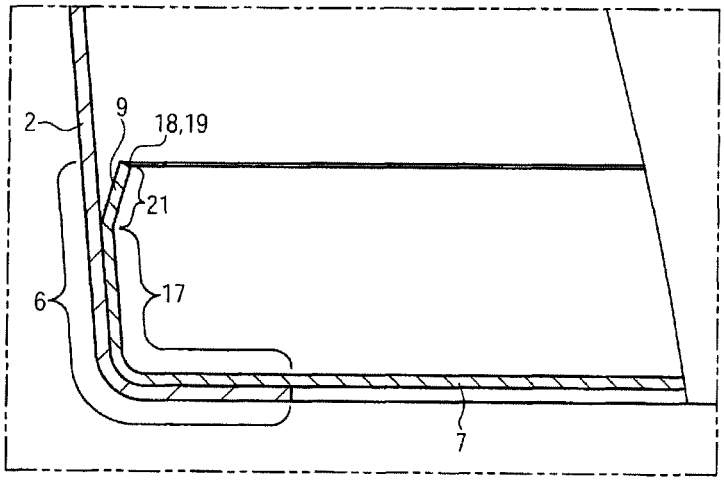
FIG. 9 is an enlarged illustration of detail "Y" of FIG. 8.

FIG. 8 illustrates a second embodiment of the container of the present invention. The container according to FIG. 8 only differs from the first embodiment according to FIG. 4 by employing another form of the abutment flange 9 of the bottom part 5. In FIG. 8 the abutment flange 9 comprises an upper end section 21 bended or folded radially inwards in an inclined direction to the container opening 4. Through that the upper end 18 or the insertion limiting means 19 is arranged with a clearance with respect to the container wall 2 as illustrated by FIG. 9. Other features correspond to those as illustrated by the previous FIGS. 4 to 7.

In FIG. 9 a detail "Y" according to FIG. 8 is illustrated in an enlarged view. In particular, it is recognizable that the contact area 17 is smaller in comparison to FIG. 5, as the upper end section 21 of the abutment flange 9 no longer constitutes a part of the contact area 17. For the rest, this embodiment corresponds to the previous embodiment and it is indicated also with respect to the double walled design of the container, to the description of the first embodiment.

Figure 10:
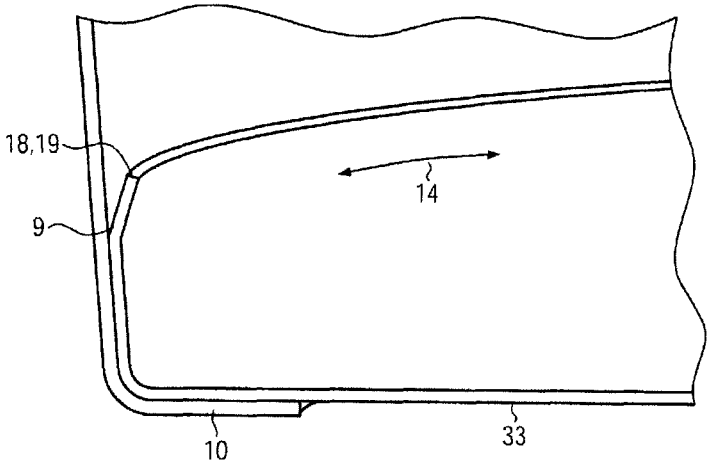
FIG. 10 is an illustration analogue to FIG. 9 in a perspective view.
Figure 11:
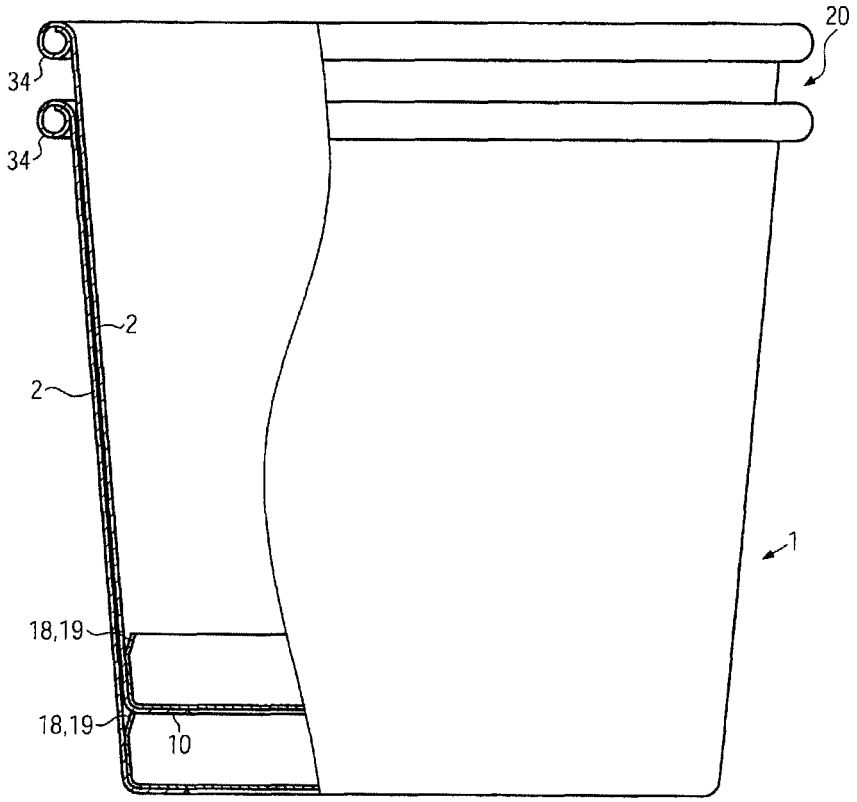
FIG. 11 is an illustration analogue to FIG. 7 for the second embodiment.

FIG. 10 illustrates a perspective view analogous to FIG. 9. It is a recognizable analogue to FIG. 6 that the upper end 18 or the insertion limitation means 19 protrudes in a circumferential direction 14, as illustrated by FIG. 11, and serves for supporting of another container 20.

In this case support of the additional container 20 is essentially achieved at the end of the support ring 10 or at the beginning of the transition 15 between the support ring 10, and the upwards protruding container wall 2. For both embodiments of container 1 according to FIGS. 4 to 11, additionally an insert 25 can be arranged, which is described in the following sections with a third embodiment of the container 1 of the present invention.

The respective features for the previous embodiments can be used in an analogous manner for the third embodiment.

Figure 12:
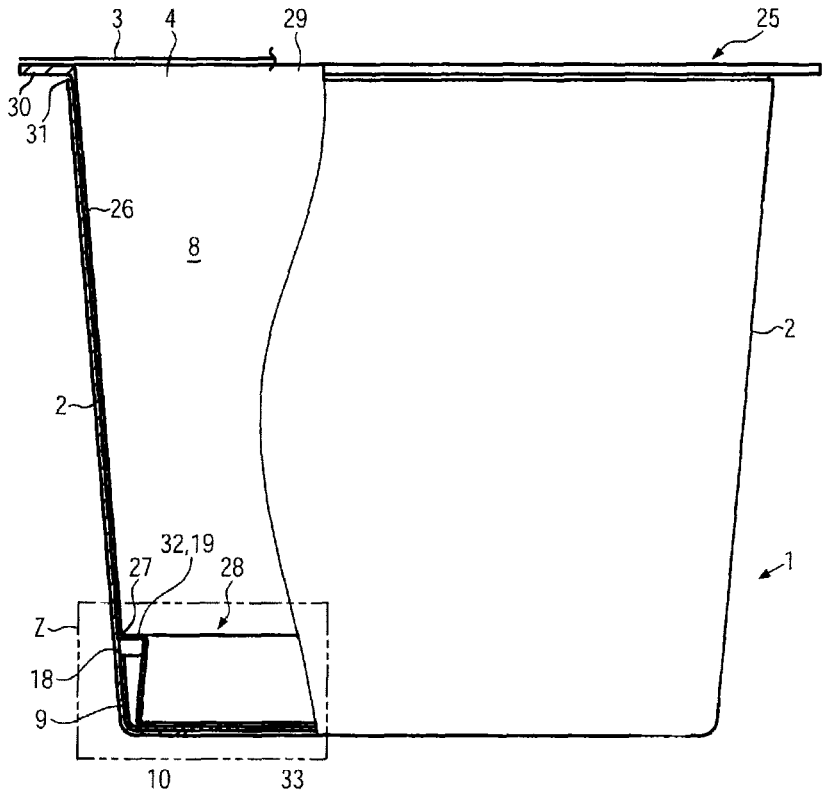
FIG. 12 is a third embodiment of the inventive container analogue to FIG. 4.

FIG. 12 partially illustrates, for example, a crossing section of the third embodiment of the container 1 analogous to FIG. 4.

The container 1 according to FIG. 12 defers from the previously described containers, for example, by the upper end 31 of the container wall 2 which does not comprise an outwardly rolled section as illustrated for example as edge 34 in FIG. 7.

For the rest, the container 1 is the same as the container of FIG. 4, in particular with respect to the bottom part 5, and the connection to the container wall 2 or the support ring 10 respectively.

In the container 1 according to FIG. 12, an insert 25 is arranged. In a cross sectional view the insert 25 is similarly formed as the container 1 and constitutes a part of the container.

The insert 25 also comprises an upper opening 29 as an insert opening, which serves as a replacement for the container opening 4, as illustrated by FIG. 4, for example for the filling and the pouring of the contents of container 1.

The insert 25 comprises an insert wall 26 which inwardly contacts the container wall 2. At its upper end, the insert wall 26 comprises a radial outwardly protruding edge flange 30 which protrudes the upper end 31 of the container wall 2.

Further, the insert 25 comprises an insert bottom part 28 which is integrally formed of a plastic material with the insert wall 26. The insert bottom part 28 stands on the flat bottom section 7 of the bottom part 5 in the container volume 8, and is connected with the same. However, there is also the option that the connection between the insert 25 and the container wall 2 can be achieved using friction alone, without additional connecting methods such as gluing or the like. Further, there is the option that the insert 25 is connected with the container wall 2 or respectively the insert bottom part 28 with the bottom part 5 by gluing with cold or hot glue respectively.

Figure 15:
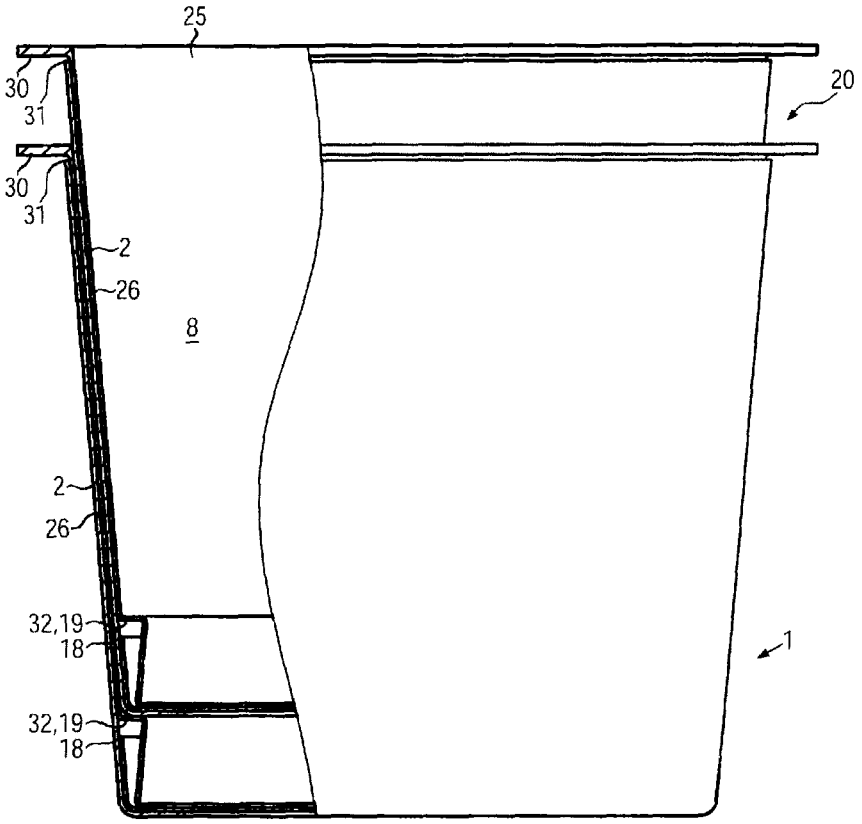
FIG. 15 is a stacked arrangement of containers analogue to FIG. 11 for the third embodiment.

At a lower end 27 of the insert wall 26 the insert bottom part 28 is connected to the insert wall 26 via a supporting step 32 protruding essentially radially inwards. The supporting step 32 serves during stapling of containers as a respective insert limiting means 19 as illustrated by FIG. 15. That means that the upper end 18 of the abutment flanges 9 no longer serve as a respective insert limiting means 19 as illustrated by FIG. 7.

Figure 13:
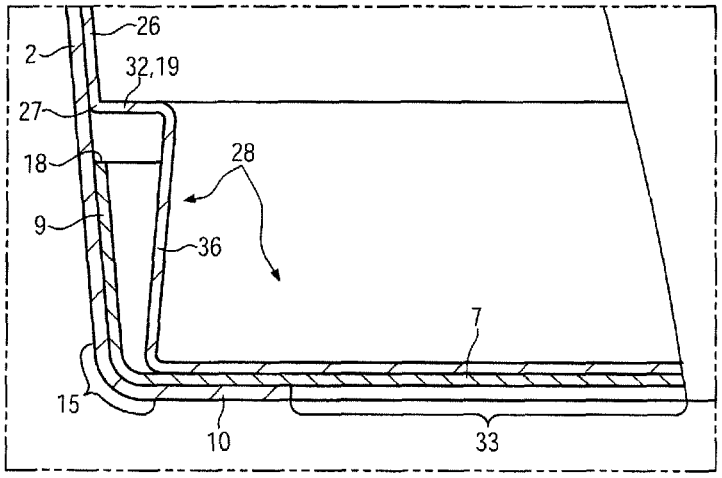
FIG. 13 is an enlarged illustration of detail "Z" of FIG. 12.

In FIG. 13, a detail "Z" of FIG. 12 is illustrated in an enlarged view. The bottom part 5 of the container 1 comprises the respective access area 33 which is surrounded by the support ring 10. The transition 15 of the support ring 10 is rounded with respect to the container wall 2 as it is also illustrated by FIG. 6.

The supporting step 32 protrudes so far in a radially inwards direction that a border wall 36 runs upwardly in an inclined direction and inwardly in direction to the insert opening 29 as it is also illustrated by FIG. 12.

The supporting step 32 forms an essentially horizontal surface for supporting another container 20 as it is also illustrated in FIG. 15. There, the supporting step 32 is upwardly arranged at the upper end 18 of the abutment flange, in the direction of the insert opening 29.

With respect to the compression load from a downward direction onto the flat bottom section 7 of the bottom part 5, a respective connection between the flat bottom part 7 and the rear side of the insert bottom part 28 can be sufficient. However, in order to induce the respective compression forces further into the other parts of the container, a respective gluing between the insert wall 26 and the container wall 2 can be suitable.

The embodiment according to FIGS. 12 to 15 can also comprise a respective double walled structure as it is illustrated in FIG. 4.

Figure 14:
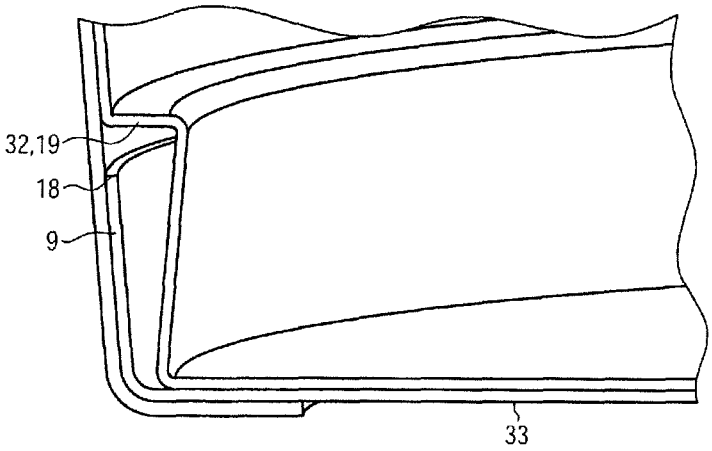
FIG. 14 is an illustration analogue to FIG. 13 in a perspective view.

FIG. 14 illustrates a perspective view analogue to FIG. 13. The supporting step 32 protrudes in a circumferential direction 14.

FIG. 15 illustrates stacked containers 1 and 20 according to the third embodiment. According to this embodiment the stacking is achieved through the insert 25 and its supporting step 32. The supporting step 32 serves as a supporting surface for the bottom part 5 of another container 20, which is inserted into the container 1.

With respect to double walled formed containers the stacking is usually carried out with a bigger clearance to the flat bottom section 7 so that for such containers the respective insert limiting means 19 are further arranged in the direction of the container opening 4 or the insert opening 29, respectively.

The description of the other embodiments according to FIGS. 4 to 11 is also suggested, wherein this description applies as an analogue for the third embodiment and in particular FIG. 15.

The container of the present invention according to the different embodiments benefits from its special bottom structure which enables a the container to stand securely on a surface with protrusions or uneven structure, and also absorbs and effectively transmits onto the container the compression loads applied onto the flat bottom section, without any influence onto the connection between the bottom part and the container wall. This also applies if compression loads applied by a device are so large that the container and in particular its wall, bottom or lid is partly destroyed to start a working step for processing the food stuff or dried beverage. In total a simple and low cost produceable container is described which additionally can comprise an insert. The container comprising the container wall and the bottom part is made of paper, carton or the like, whereas the insert generally is made of plastic material. In particular, the container has a cup-shaped form with a round cross section. This applies in analogous fashion for the insert.

With respect to a method for the production of a previously described container, in general, the following method steps are conducted:

i. Production of a container wall of a two dimensional pre-cut through connecting the container wall along an overlapping section of the container wall,
ii. Insertion of a particularly pre-fabricated bottom part through the container opening into the container, and
iii. Connection of the support ring and the lower end section of the container wall with the abutment flange and/or bottom area of the bottom part.

Optionally:

a. The support ring is folded briefly before the insertion of the bottom part or if the bottom part is already inserted relatively towards the container wall;
b. The abutment flange is pressed in particular wrinkle-free to the inner side of the container wall;
c. The abutment flange comprises load releasing cuts for a wrinkle-free arrangement at the inner side of the container wall;
d. The bottom part and/or the respective parts of the container wall are supplied with adhesives;
e. From inwards and outwards a compression-/heating element compresses at least the abutment flange and the container wall for their connection through a coating;
f. From upwards and downwards a compression-/heating element compresses the bottom section and the support ring for their connection through a coating;
g. e. and f. are conducted by a tooling in one method step;

h. Before and after insertion of the bottom part, the upper end section of the abutment flange is bent or folded;

i. Support ring and/or abutment flange are folded wrinkle-free under heat impact and/or under mechanical impact;

j. The insert is inserted or pushed into the already prefabricated container made of the container wall and the bottom part; or k. The insert is connected in its insert position with the container and in particular with the container wall and/or the bottom part through additional adhesives and/or coating of the container in the area of the container wall and/or the bottom part.

What is claimed is:

1. A container for receiving foodstuff or dried beverages comprising:

an outer container wall;

an inner container wall in contact with the outer container wall;

an upper container opening;

a bottom part opposite to the container opening and connected to a lower end section of the outer container wall;

wherein the bottom part includes an essentially flat bottom section and an abutment flange which protrudes at least in places from the bottom section in the direction of the container opening;

wherein the lower end section of the outer container wall comprises a support ring protruding radially inwards from the end section, the support ring extending substantially along a radial plane;

wherein a connection of the bottom part and the lower end section is effected between the flange and an inner side of the outer container wall, and between the lower side of the bottom section and an upper side of the support ring; and wherein an upper end of the flange extends parallel to the container wall in the direction of the container opening, wherein the inner container wall comprises:

a bottom surface parallel to and in contact with the essentially flat bottom section of the bottom part;

a support surface extending parallel to the bottom surface in a horizontal direction; and an inclined surface extending from the bottom surface to the support surface in an inward direction, and wherein the support surface is configured to abut a lower surface of a support ring of a second container provided immediately above the support surface, when said containers are stacked, such that the support surface limits insertion of the second container into the container and wherein the abutment flange and the flat bottom surface are formed from one single unitary onepiece structure, wherein the abutment flange extends directly from a perimeter portion of the flat bottom section toward the direction of the container opening.

2. The container according to claim 1 wherein the outer and inner container wall and/or the bottom part comprise paper or cardboard.

3. The container according to claim 1 which comprises a fluid impermeable coating on the inner container wall wherein the bottom part is coated with the fluid impermeable coating on both sides.

4. The container according to claim 1 wherein the supporting ring surrounds an access section of the flat bottom section.

5. The container according to claim 1 wherein the container wall comprises a rolled or folded edge at its upper end.

6. The container according to claim 1 which comprises an insert having at least an insert wall and an insert bottom part at the lower end of the insert wall, and the insert bottom wall rests on the bottom section.

7. The container according to claim 6 wherein the insert bottom part and bottom part are sealingly joined or fixed to each other.

8. The container according to claim 7 wherein the insert comprises an edge flange at its upper insert opening the edge flange protruding radially outwards the at least some locations.

9. The container according to claim 8 wherein the edge flange overlaps an upper end of the container wall affixing a lid part.

* * * * *